United States Patent [19]

Caknis

[11] 4,113,176

[45] Sep. 12, 1978

[54] AIR-CONDITIONING

[76] Inventor: Nicholas Caknis, 24, Farmers Folly, Lynnwood, Pretoria, South Africa

[21] Appl. No.: 678,742

[22] Filed: Apr. 21, 1976

[51] Int. Cl.[2] ..... F24F 7/00

[52] U.S. Cl. ..... 236/49; 98/38 E

[58] Field of Search ..... 236/49, 80 D; 98/38 E; 137/8, 597, 805, 826, 79

[56] References Cited

U.S. PATENT DOCUMENTS

| | | | |
|---|---|---|---|
| 3,117,723 | 1/1964 | Church | 236/49 |
| 3,653,588 | 4/1972 | Dreibelbis | 236/49 |
| 3,923,244 | 12/1975 | Osheroff | 236/49 |

*Primary Examiner*—William E. Wayner
*Assistant Examiner*—Larry Jones
*Attorney, Agent, or Firm*—Haseltine, Lake & Waters

[57] ABSTRACT

An air discharge terminal unit comprising a housing which has an air inlet and an air outlet. Means is provided between the air inlet and air outlet for dividing an air flow through the unit into primary and secondary air streams, each of which moves in a path, further means is provided for reducing the pressure of the secondary air to a value lower than that of the primary air and means is provided for varying the path of the primary air stream to interact selectively with the secondary air stream to control the rate of flow of air through the outlet.

8 Claims, 9 Drawing Figures

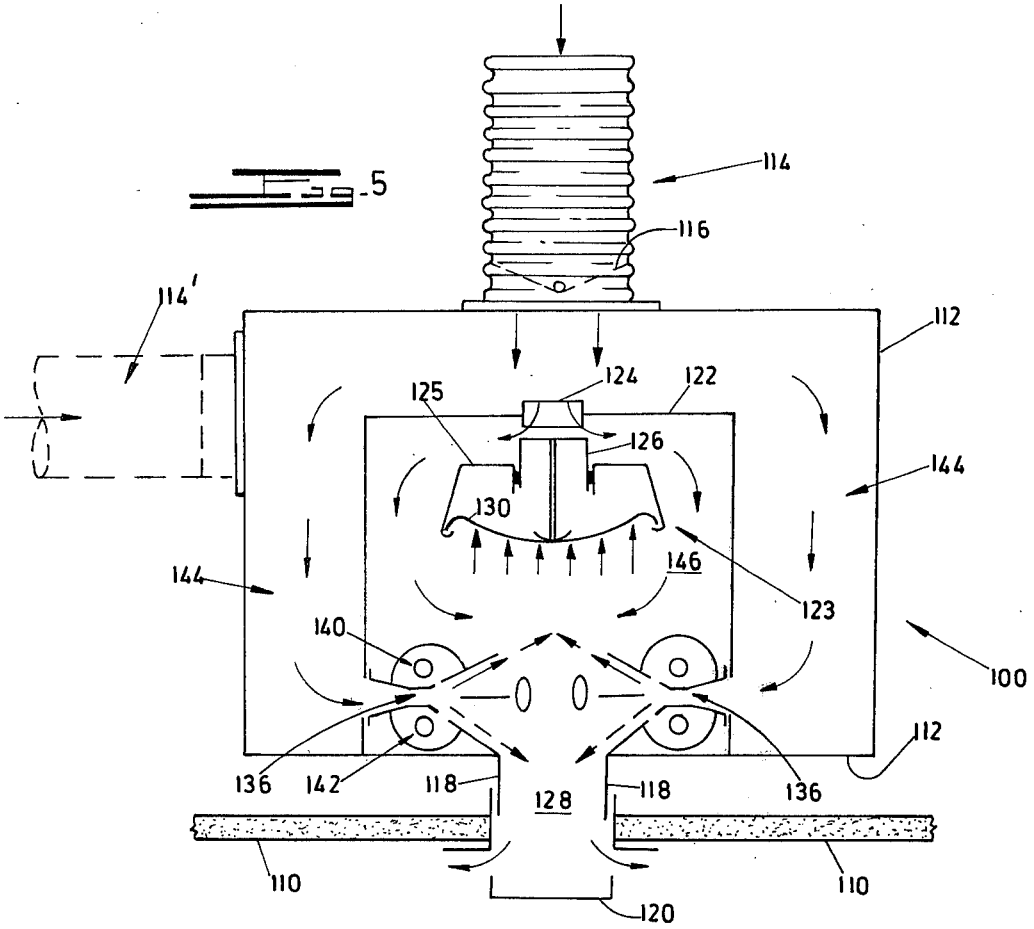
5
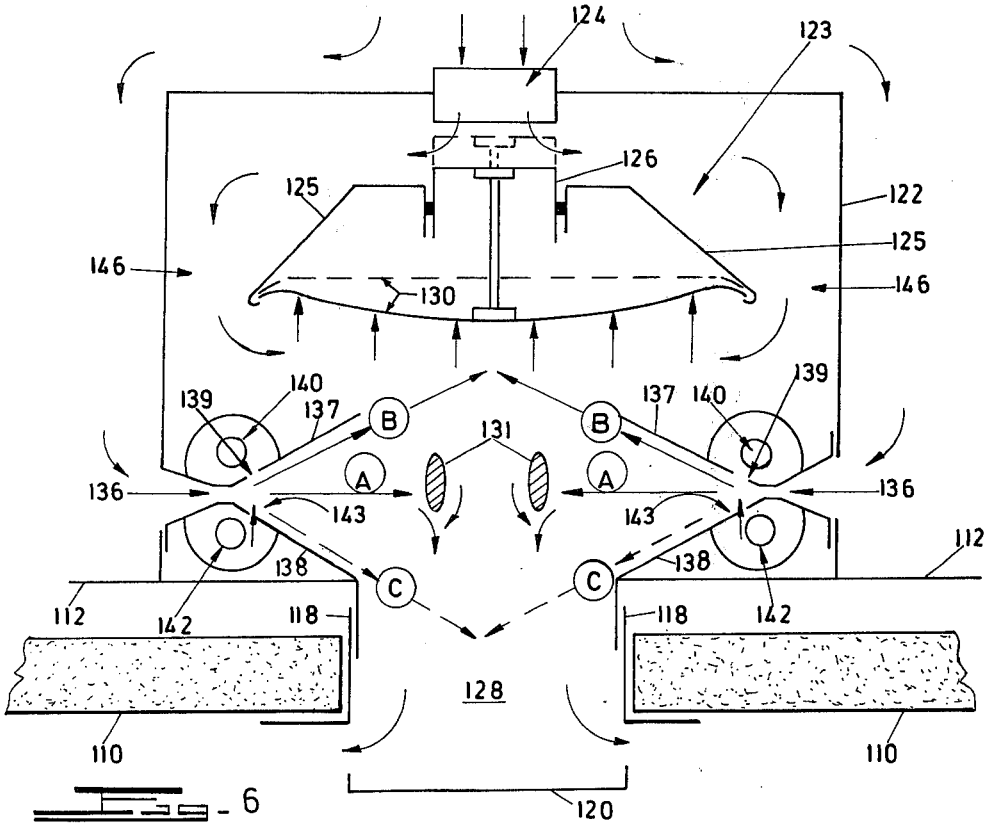
6

AIR-CONDITIONING

This invention relates to improvements in or relating to air conditioning. In particular, it relates to an air discharge terminal unit or air diffuser suitable for use in an air conditioning system.

According to the invention an air discharge terminal unit comprises a housing having an air inlet and an air outlet, means between the air inlet and the air outlet for dividing an air flow through the housing into primary and secondary air streams, means for reducing the pressure of the secondary air stream to a value lower than that of the primary air stream, and means for directing a stream of primary air onto the secondary air stream to control the flow of air from the air outlet.

The primary air stream directing means may be adapted to direct a pair of opposing jets of primary air onto the secondary air stream. In particular, it may be adapted to direct the jets of primary air in directions substantially perpendicular to the secondary air stream, or in directions which are inclined to the secondary air stream.

The unit may include a temperature sensitive control device adapted to control the volume ratio of the primary and secondary air streams responsive to the temperature in an air conditioned space.

Further according to the invention, an air discharge terminal unit comprises a housing with an air inlet and an air outlet, means between the inlet and the outlet for dividing an air flow through the housing into primary and secondary air streams, each of which moves in a path, means for reducing the pressure of the secondary air stream to a value lower than that of the primary air stream, and means for varying the path of the primary air stream to interact selectively with the secondary air stream to control the rate of flow of air through the outlet.

The unit may include means for directing a pair of opposing jets of primary air onto the secondary air stream. When any air stream emerges as a jet from an outlet there occurs a natural phenomenon that one or more negative pressure zones are formed to the side of the air stream adjacent the outlet. The invention utilizes this phenomenon in one of its embodiments and provides that the varying means comprises means to direct a jet of air into the negative pressure zone formed by the primary air stream. This causes the primary air stream to deflect on a fluidics logic principle resulting from the fact that the jet of air interacts with the negative pressure zone which causes the primary air stream to deflect.

Means may be provided to direct a jet of air into the negative pressure zone to either side of the primary air stream. With this arrangement, the primary air stream can be controlled to move in predetermined paths to either side of its neutral position. Tests have shown that when the primary air jets are in their neutral position, i.e. substantially perpendicular to the secondary air stream, or in positions in which they are inclined in directions upstream of the secondary air stream, they act as an air gate which reduces or prevents the secondary air stream from flowing through the outlet. Tests have further shown that when the primary air stream jets are inclined in directions downstream of the secondary air stream, they no longer act as an air gate and the flow of secondary air is not impeded.

Thus, in one embodiment of the invention, the means for varying the path of the primary air stream may be adapted to direct jets of air alternately into the negative pressure zones on opposite sides of the opposing jets of primary air.

The means for directing jets of air into the negative pressure zones of the primary air jets may comprise first conduit means having openings positioned to direct air jets into the negative pressure zones on corresponding sides of the primary air jets and second conduit means having openings positioned to direct air into the negative pressure zones on the opposite sides of the primary air jets.

The unit may further include a fluidics logic pilot valve for selectively controlling the flow of air to the first and second conduit means. The unit may also include a thermostat operatively connected to air flow regulating means for controlling the operation of the pilot valve.

The thermostat may comprise a bi-metallic element which is operatively connected to the air flow regulating means.

In use, a small quantity of return air from the air conditioned space may be induced over the thermostat for sensing the temperature to control the operation of the unit. For this purpose, the bi-metallic element of the thermostat may be located in the path of the "induced air stream" adjacent the outlet of the unit.

In an alternative embodiment, the thermostat may be located in the air conditioned space itself.

Also according to the invention there is provided a method of controlling the passage of air from an air diffuser outlet comprising the steps of admitting air to the air diffuser; dividing the air flow through the air diffuser into primary and secondary air streams, each of which moves in a path; reducing the pressure of the secondary air stream to a value lower than that of the primary air stream; and varying the path of the primary air stream to interact with the secondary air stream to vary the rate of flow or air from the outlet between minimum and maximum rates of flow.

The invention will now be described, by way of examples, with reference to the accompanying schematical drawings, in which:

FIG. 5 is an end view of a further embodiment of an air discharge terminal unit according to the invention, with its end part removed for illustrative purposes;

FIG. 6 is a view similar to that of FIG. 5, showing a part of the unit on an enlarged scale;

Figure 1:
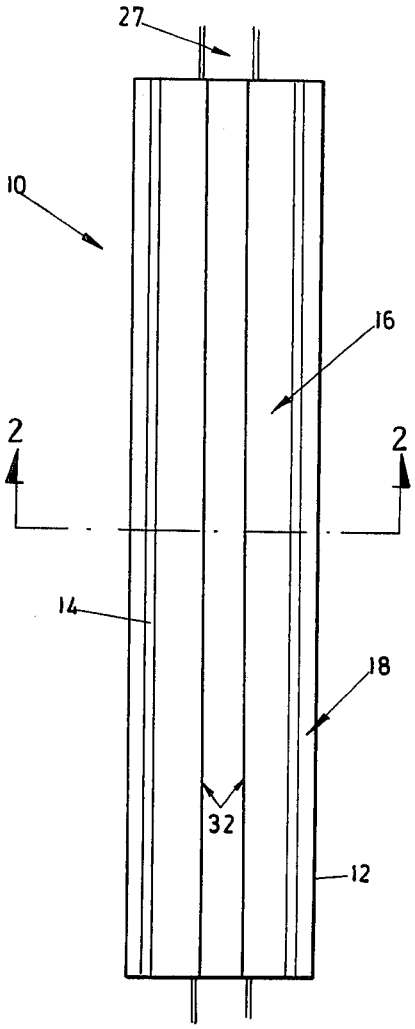
FIG. 1 is a section taken along the lines I—I in FIG. 2 and shows an air discharge terminal unit, according to one embodiment of the invention.
Figure 2:
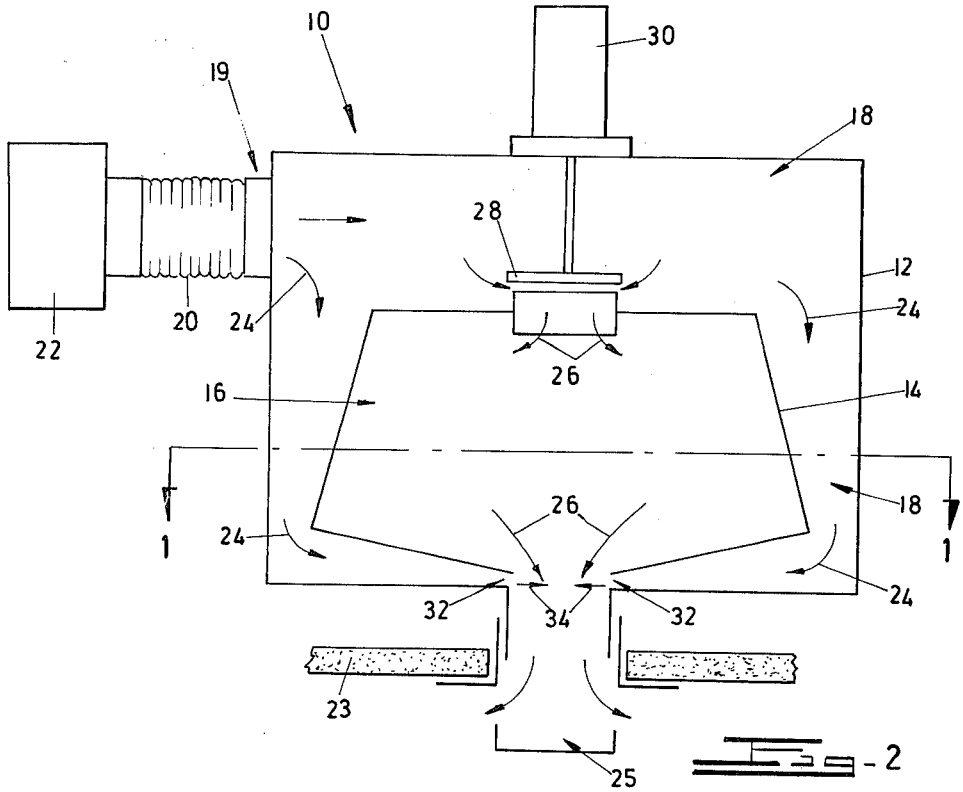
FIG. 2 is a section taken along the lines II—II in FIG. 1.

Referring to FIGS. 1 and 2, reference numeral 10 generally indicates an air discharge terminal unit comprising an elongate outer housing 12 and an elongate inner housing 14. The inner housing 14 defines an air space 16 whilst an air channel 18 is defined between the inner housing 14 and the outer housing 12. The air discharge terminal unit 10 has an air inlet 19 which is connected, via a flexible connecting tube 20, to a main air supply 22.

The air discharge terminal unit 10 is mounted in a ceiling void of an office, room or the like. In FIG. 2, reference numeral 23 denotes a ceiling of the office, room, or the like. The unit 10 has an elongate outlet 25 which is in register with a slot 27 in the ceiling 23.

As shown, both the air space 16 and the air channel 18 are in communication with the main air supply 22. The air from the main air supply 22 is, therefore, divided into a primary air stream, denoted by the arrows 24, and a secondary air stream, denoted by the arrows 26.

The amount of air entering the space 16 can be varied by means of a movable plate 28, actuated by a pneumatic actuator 30 or other suitable controlling device which in turn is controlled by a pneumatic thermostat or other suitable sensing device (not shown) located within the air conditioned space, i.e. the office, room or the like.

The function of the secondary air stream is to offset the heat load within the air conditioned space due to heat gains resulting from transmission, solar, people, lights and other equipment heat loads.

A slot 32 is provided in each of the opposed longitudinal walls of the inner housing 14. The slots 32 are arranged in an opposed pair. In use, primary air will flow through these slots 32 creating a pair of opposed air jets, denoted by the arrows 34.

As shown in FIG. 2, the slots 32 are located to discharge the primary air /streams towards each other. The air jets 34 will, therefore, impinge on the secondary air stream flowing through outlet 25 thereby to control the flow rate of the secondary air stream and maintain a constant air discharge velocity, as will be described in more detail below. The unit 10 operates as follows:

Air enters the unit 10 from the main air supply 22 and is divided into a primary and secondary air stream.

As the heat load in the room decreases, the plate 28 will be moved towards the air inlet opening in the inner housing 14 thereby restricting the flow of secondary air into the space 16 and consequently decreasing the secondary air pressure. This results in the higher pressure of the primary air stream to cause the air jets 34 to impinge on the secondary air stream with greater force. This action tends effectively to reduce the outlet opening 25 of the unit 10 for the outflow of secondary air. The reduced outlet opening has the effect of increasing the velocity of the secondary air stream thereby tending to compensate for the reduced discharge velocity of the secondary air stream at reduced loads.

It is an advantage of the unit 10 that desired air outlet throws and air outlet spreads are maintained irrespective of a decrease or increase of the room heat load.

Figure 3:
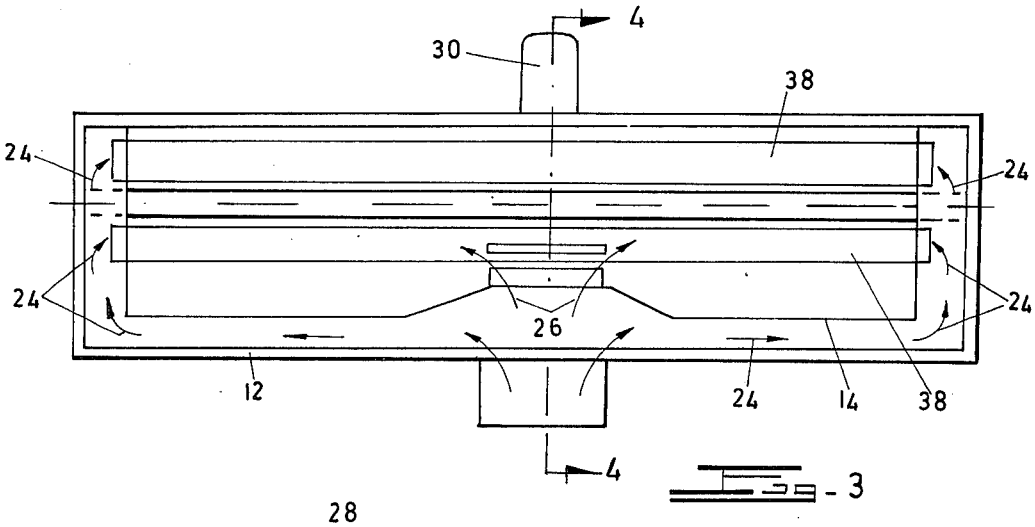
FIG. 3 is a plan view of an air discharge terminal unit according to another embodiment of the invention.
Figure 4:
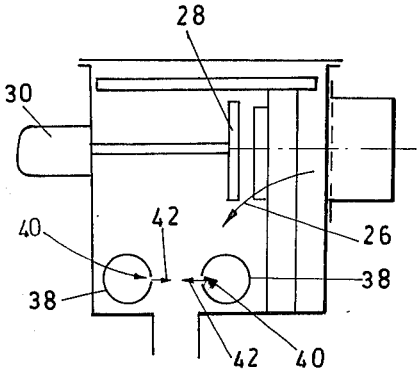
FIG. 4 is a section taken along the lines IV—IVin FIG. 3.

The embodiment shown in FIGS. 3 and 4 differs from the unit 10, already described, in that a pair of parallel tubes 38 are provided for the primary air stream. The tubes 38 are each provided with a slot 40 for the primary air to impinge on the secondary air, the slots 40 again being arranged in an opposed pair.

In this embodiment, the slots 40 are positioned in such a way so as to result in the air jets being discharged towards each other as shown by the arrows 42.

The air discharge unit 10 may either be used on a single duct air conditioning system or, alternatively, on dual duct or dual conduit air conditioning systems. In the latter two systems, the primary and secondary air systems would be separately ducted and the primary air capacity would be selected to offset transmission heat gains and heat losses to the air conditioned space.

Referring now to FIGS. 5 to 9, reference numeral 100 generally indicates an air discharge terminal unit for mounting in a ceiling void of an office, room or the like. The unit 100 is shown in place on a false ceiling 110.

Figure 7:
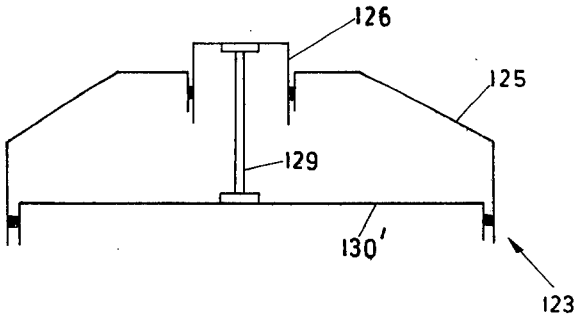
FIG. 7 is a view of an alternative air pressure regulating device to that shown in FIG. 6, and which forms an alternative embodiment of the invention.

The unit 100 comprises a housing 112 having an air inlet from a pressure duct 114 (an alternative position for the air inlet is shown in outline at 114' in FIG. 5) with a preset adjustable damper 116 and an outlet 118 from the housing 112. A baffle 120 is positioned outside the outlet 118. Inside the housing 112 is an envelope 122 having an inlet 124 which extends over the length of the housing 112. In a position below the inlet 124 is situated an air pressure regulating device 123 which also extends over the length of the housing 112. The air pressure regulating device 123 comprises a casing 125 which contains a sliding damper 126 which is coupled by a connecting plate 129 to a neoprene diahpragm 130 which is fixed to the lower portion of the casing 125. A sheet metal piston 130', having an inverted channel profile, may be used as an alternative for the neoprene diaphragm 130. The alternative arrangement is shown in FIG. 7. The housing 112 has an air discharge opening 128 which extends over the length of the housing 112.

The housing 112 and the envelope 122 are spaced apart to provide an air chamber 144 which has primary air stream nozzle openings 136 which are defined between primary air stream nozzle blades 137 and 138.

The primary air-stream nozzle blades 137 and 138 contain control air slots 139 and 143 which extend over the full length of the nozzle blades 137 and 138. Control air channels are formed over the control air slots 139 and 143. These channels are provided with control air openings 140 and 142. To these control air openings 140 and 142 are fitted upper control tubes and lower control tubes (see FIG. 9).

The chamber 144 between the housing 112 and envelope 122 forms a plenum chamber for primary air. The envelope 122 defines another plenum chamber 146 for secondary air.

Figure 8:
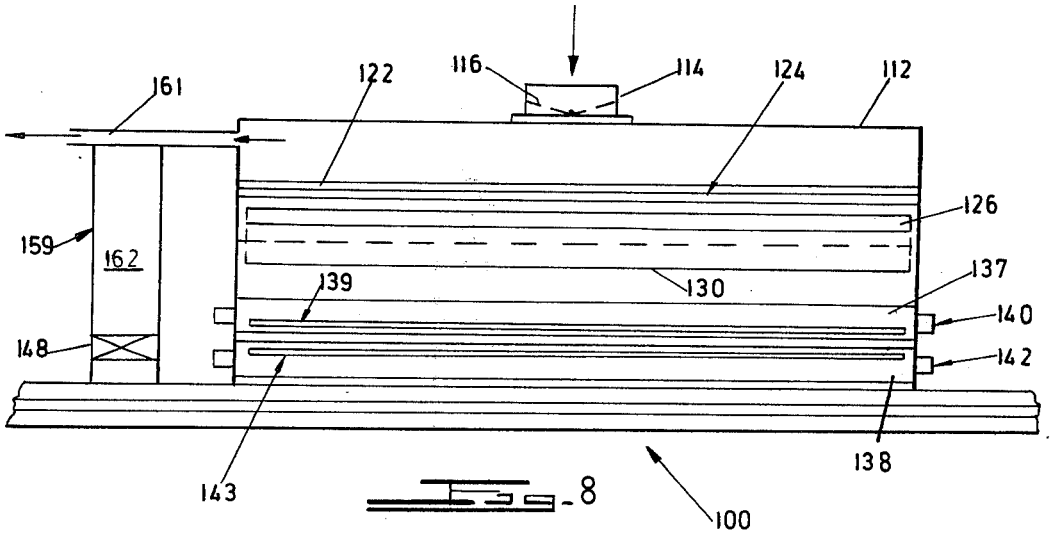
FIG. 8 is a side view of unit of FIG. 5, with its side removed for illustrative purposes.

A control thermostat assembly 159 is shown in FIG. 8. This assembly 159 forms an integral part of the air discharge terminal unit 100. A control thermostat 148 (see also FIG. 9) is situated in a casing 162 which communicates with a horizontal conduit 161 which is of small dimensions. A fluidics logic pilot valve assembly 165 (see FIG. 9) is also coupled to the air discharge terminal unit 100.

Figure 9:
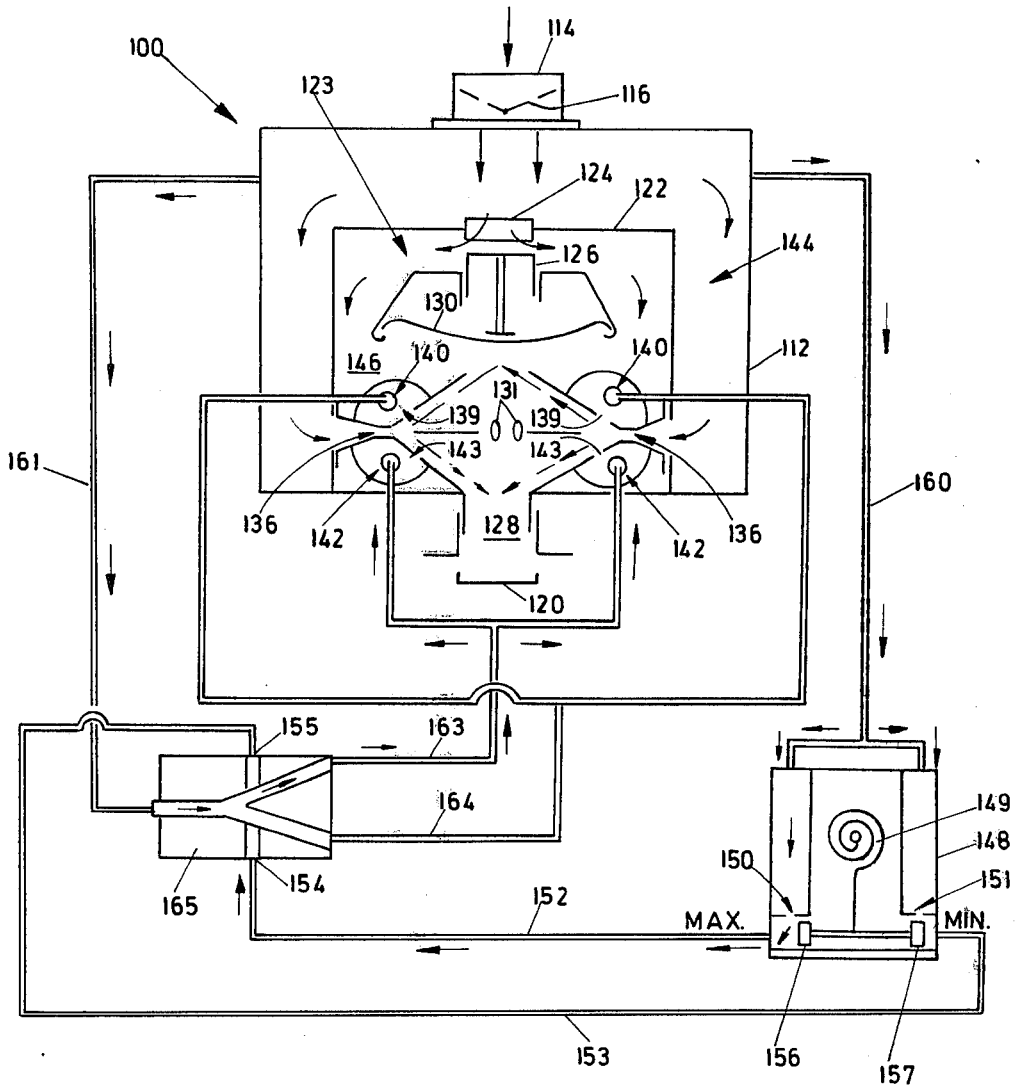
FIG. 9 is a diagrammatical representation of an air conditioning control system incorporating the air discharge terminal unit of FIG. 5.

In FIG. 9, the control air openings 140 and 142 of the control air channels are shown together with means for controlling the flow of air through them. The control means comprises the control thermostat 148, which contains a bi-metallic element 149 which in turn controls air flow regulating means in the form of pistons 156 and 157 which either open or close ports 150 or 151, respectively, depending on the induced return air flowing over the bi-metallic element 149.

In use, air at primary air pressure is continuously supplied to right and left hand chambers in the thermostat 148 via a conduit 160. These chambers contain the ports 150 and 151. By the action of the bi-metallic element 149, the pistons 156 and 157 either open or close the ports 150 and 151, respectively. When either one or the other port is opened, control air is allowed to flow in either conduit 152 or 153, which respectively communicate with air inlets 154 and 155 of the pilot valve 165.

This action will cause the primary control air, which is continuously supplied to the pilot valve 165, via the conduit 161, to be diverted either to pilot valve discharge conduit 163 or to pilot valve discharge conduit 164. The discharge conduit 163 communiates with the primary air stream control openings 142 and the discharge conduit 164 communicates with the primary air stream control openings 140.

The operation of the air discharge terminal unit 100 is as follows:

Air at pressure P1 is supplied through the duct 114 to the primary air plenum chamber 144. This primary air divides into two streams, one of which passes around the envelope 122 to emerge from the nozzle openings 136 substantially at a pressure P1. This is termed the "primary air-stream." The other stream passes into secondary air plenum chamber 146, formed by the envelope 122, and is reduced in pressure by the air pressure regulating device 123, to a pressure P2. This is effected by the air entering the inlet 124 acting on the top surface of the damper 126 and depressing the damper 126. The air, therefore, flows into the secondary air plenum 146 at the lower pressure P2. The flow of the primary and secondary air streams is denoted by arrows in the drawings.

For the primary air stream jets emerging from the nozzle openings 136, to operate as an air gate to control the flow of secondary air into the air conditioned space, the secondary air pressure P2 must be lower than the primary air pressure P1. The air pressure regulating device 123 ensures this condition.

Assuming the primary air jets to be in the upward direction and acting as an air gate, the secondary air flow entering the secondary air plenum chamber 146 will be opposed. The secondary air flow entering via the air pressure regulating device 123 will tend to increase to the pressure P1. The secondary air pressure is, however, maintained at pressure P2 by the action of the rising secondary air pressure acting on the neoprene diaphragm 130, which has a larger surface area than the damper 126, and which results in the damper 126 moving in an upward direction and restricting the primary air flow through the opening 124 and, therefore, maintaining a constant secondary air flow pressure at pressure P2.

As described above, the primary air-stream discharges into the secondary plenum 146 in the form of two opposed air jets at pressure P1. In terms of fluidic logic principles, the primary air jets are in their neutral positions when they are in a horizontal position (A) in FIG. 6 and negative pressure zones exist above and below the air jets at the points of discharge from the nozzle openings 136.

Three basic patterns of the air discharged through the unit 100 may be distinguished for the purpose of explanation as air volume increases progressively from minimum to maximum in dependence on the heat load in the room. The operation is controlled by air being supplied to the control air openings 140 and 142 on a fluidic logic principle as will be further described below.

The three basic air flow patterns are:

Minimum Heat-Load

Control air enters the chambers of the thermostat 148 from the primary air plenum 144, via control conduit 160. The bi-metallic element 149 of the thermostat 148 is in a minimum heat load state and the air control piston 156 has opened the port 150 (as shown in FIG. 9) allowing control air to flow to the pilot control valve port 154 via conduit 152. This action causes the primary control air flowing from the primary air plenum 144 to the pilot valve 165, via control conduit 161, to be deflected to the pilot valve discharge conduit 163 through which the control air flows to the primary air stream nozzle openings 142. The air is discharged in the form of jets through the slots 143, into the negative pressure zones on the lower sides of the primary air jets. This causes the primary air jets to be deflected upwardly to position (B) in FIG. 6. The flow of secondary air is restricted and a condition of minimum air flow into the room is maintained.

Moderate Heat-Load

As the heat load in the air conditioned space increases, the thermostat 148 allows the primary air-stream to return to its neutral position as indicated in position (A) in FIG. 6. This action is caused by the thermostat air control pistons 156 and 157 having closed both thermostat ports 150 and 151.

At this thermostat position no control air flows to the ports 154 and 155 of the pilot valve 165. The pilot valve 165 is then in a neutral state and the primary air flow from the chamber 144, via the control conduit 161, is discharged from the pilot valve 165 in equal proportions into the discharge conduits 163 and 164. The control air is then delivered in equal proportions to the control air openings 140 and 142 and the primary air streams are not deflected.

At this position the primary air streams interact partially with baffles 131 and consequently lose energy so that the pressure of the primary air stream gate effect decreases thus allowing a moderate amount of secondary air to flow through the outlet 128 and a condition of moderate air flow into the air conditioned space is maintained.

High Heat-Load

In this condition, the control thermostat 148 allows control air to flow through the port 151 and then to the port 155 of the pilot valve 165 via the conduit 153. This action causes the primary air flow from the primary air plenum 144 to the pilot valve 165, via control conduit 161, to be deflected to the discharge conduit 164. In this event, control air flows into the upper control air openings 140. Air is discharged in the form of jets through the slots 139 into the negative pressure zones on the upper sides of the primary air jets. This causes the primary air jets to be deflected downwardly to position (C) in FIG. 6. When the primary air streams are in this position, the flow of secondary air is not impeded and the air discharge unit is in a state of maximum air discharge into the air condition space.

From the above description, it can be seen that the air flow can be controlled from minimum to maximum air discharge rates in response to the control thermostat 148 with the desired air throws and spreads being maintained throughout the range of air discharge rates. The unit 100 also does not require an external control source as the unit operates solely from supply duct air pressure at pressure P1.

According to fluidics logic principles, if the width of the nozzles 136 is given by $x$, the width of the slots 139 and 143 should be between a value of $1.6x$ to $2x$.

I claim:

1. An air discharge terminal unit comprising a housing with an air inlet and an air outlet, means between the inlet and the outlet for dividing an air flow through the housing into primary and secondary air streams, means for directing a pair of opposing jets of primary air onto the secondary air stream, and means for directing jets of air onto opposing jets of primary air comprising first conduit means having openings positioned to direct air jets into the negative pressure zones on corresponding sides of the primary air jets and second conduit means having openings positioned to direct air into the negative pressure zones on the opposite sides of the primary air jets.

2. A unit according to claim 1, including a fluidics logic pilot valve for selectively controlling the flow of air to the first and second conduit means.

3. A unit according to claim 1, including a thermostat operatively connected to air flow regulating means in communication with the pilot valve for controlling the operation of the pilot valve.

4. A unit according to claim 3, wherein the thermostat comprises a bi-metal element operatively connected to the air flow regulating means.

5. A method of controlling the passageof air from an air diffuser outlet comprising the steps of admitting air to the air diffuser, dividing the air flow through the diffuser into primary and secondary air streams and directing a pair of opposed jets of primary air onto the secondary air stream to control the outflow of secondary air from the diffuser.

6. A method according to claim 5, wherein the direction of the primary air jets is varied by directing a jet of air into the negative pressure zone to either side of each of the opposing jets of primary air.

7. A method according to claim 6, wherein the air jets directed into the negative pressure zones are controlled by a thermostat responsive to the temperature in the air conditioned space.

8. A method according to claim 7, wherein a portion of the return air recycled from the air conditioned space is induced over the thermostat for sensing the temperature in the air conditioned space.

* * * * *